United States Patent [19]

Petersdorf

[11] Patent Number: 4,685,664

[45] Date of Patent: Aug. 11, 1987

[54] SHEET COPYING DEVICE

[75] Inventor: Gerhard Petersdorf, Pohlheim, Fed. Rep. of Germany

[73] Assignee: Canon Kabushiki Kaisha, Tokyo, Japan

[21] Appl. No.: 838,886

[22] Filed: Mar. 11, 1986

Related U.S. Application Data

[63] Continuation of Ser. No. 504,667, Jun. 15, 1983, abandoned.

[30] Foreign Application Priority Data

Jun. 19, 1982 [DE] Fed. Rep. of Germany ..... 3223048

[51] Int. Cl.[4] ..... B65H 7/14

[52] U.S. Cl. ..... 271/227; 226/20; 271/236; 271/242; 271/250; 271/270

[58] Field of Search ..... 271/270, 314, 271, 242, 271/227, 228, 250, 248, 252, 236, 237, 238; 226/20, 19

[56] References Cited

U.S. PATENT DOCUMENTS 2,786,675 3/1957 Montefalco et al. ..... 226/20
3,241,831 3/1966 Axlid ..... 271/227
3,743,277 7/1973 Bolza-Schünemann ..... 271/250 X
3,863,913 2/1975 Hirafuji ..... 271/270
3,966,198 6/1976 Komada et al. ..... 271/270 X

FOREIGN PATENT DOCUMENTS 1256289 12/1971 United Kingdom ..... 271/314

*Primary Examiner*—Richard A. Schacher
*Attorney, Agent, or Firm*—Fitzpatrick, Cella, Harper & Scinto

[57] ABSTRACT

This specification discloses a sheet conveying device for correcting oblique feeding of sheets and conveying the sheets in a predetermined direction of conveyance. The sheet conveying device has first sheet conveying apparatus for conveying sheets, second sheet conveying apparatus provided downstream of the first sheet conveying apparatus with respect to the direction of conveyance, and apparatus for forming a loop between the first and the second sheet conveying apparatus by the conveying force of the first sheet conveying apparatus and thereafter displacing the second sheet conveying apparatus holding a sheet thereon in a direction perpendicular to the predetermined direction of conveyance.

3 Claims, 10 Drawing Figures

SHEET COPYING DEVICE

This application is a continuation of application Ser. No. 504,667 filed June 15, 1983, now abandoned.

BACKGROUND OF THE INVENTION

1. Field of the Invention

This invention relates to a sheet conveying device applied to an image forming apparatus such as an electrophotographic copying apparatus, a micro instrument or a recording apparatus. Particularly, it relates to a sheet conveying device which is capable of correcting the direction of conveyance of a sheet when the sheet becomes deviated from a predetermined direction of conveyance in the course of conveyance, and conveying the sheet in the predetermined direction of conveyance.

2. DESCRIPTION OF THE PRIOR ART

An example of the oblique feeding correcting device according to the prior art is of a construction in which a pair of correcting rollers disposed obliquely with the direction of movement of a paper sheet are provided and this pair of correcting rollers are caused to strike against a reference edge when the paper sheet is liberated from the last pair of conveyor rollers and then the paper sheet is fed forwardly along the reference edge. A disadvantage peculiar to such construction is that the correction of the oblique feeding of the passing paper sheet effected by the obliquely disposed correcting rollers does not take place until the paper sheet is liberated from the last pair of conveyor rollers. When not in such a situation, said rollers impart a load to the paper sheet and therefore may sometimes wrest or wrinkle the paper sheet. Also, the rollers may erase the image on the paper sheet and this is particularly inconvenient, for example, when the paper sheet in the copying apparatus bears thereon an unfixed toner image or the like. Moreover, even when the paper sheet finally comes into contact with the reference edge and further moves forward along the reference edge in said direction, the correcting rollers may erase the image on the paper sheet in the same manner as described previously.

SUMMARY OF THE INVENTION

It is an object of the present invention to provide a sheet conveying device which is capable of quickly correcting oblique feeding of a sheet.

It is another object of the present invention to provide a sheet conveying device which is capable of correcting oblique feeding of a sheet without applying a load to the sheet.

It is still another object of the present invention to provide a sheet conveying device which is capable of correcting oblique feeding of a sheet without injuring the surface of the sheet.

It is yet still another object of the present invention to provide a sheet conveying device which is capable of correcting oblique feeding of a sheet at a short distance.

It is a further object of the present invention to provide a sheet conveying device which is capable of correcting a sheet deviated parallel with respect to a predetermined direction of conveyance into a predetermined conveyance path.

The invention will become fully apparent from the following detailed description thereof taken in conjunction with the accompanying drawings.

Figures 6, 6B:
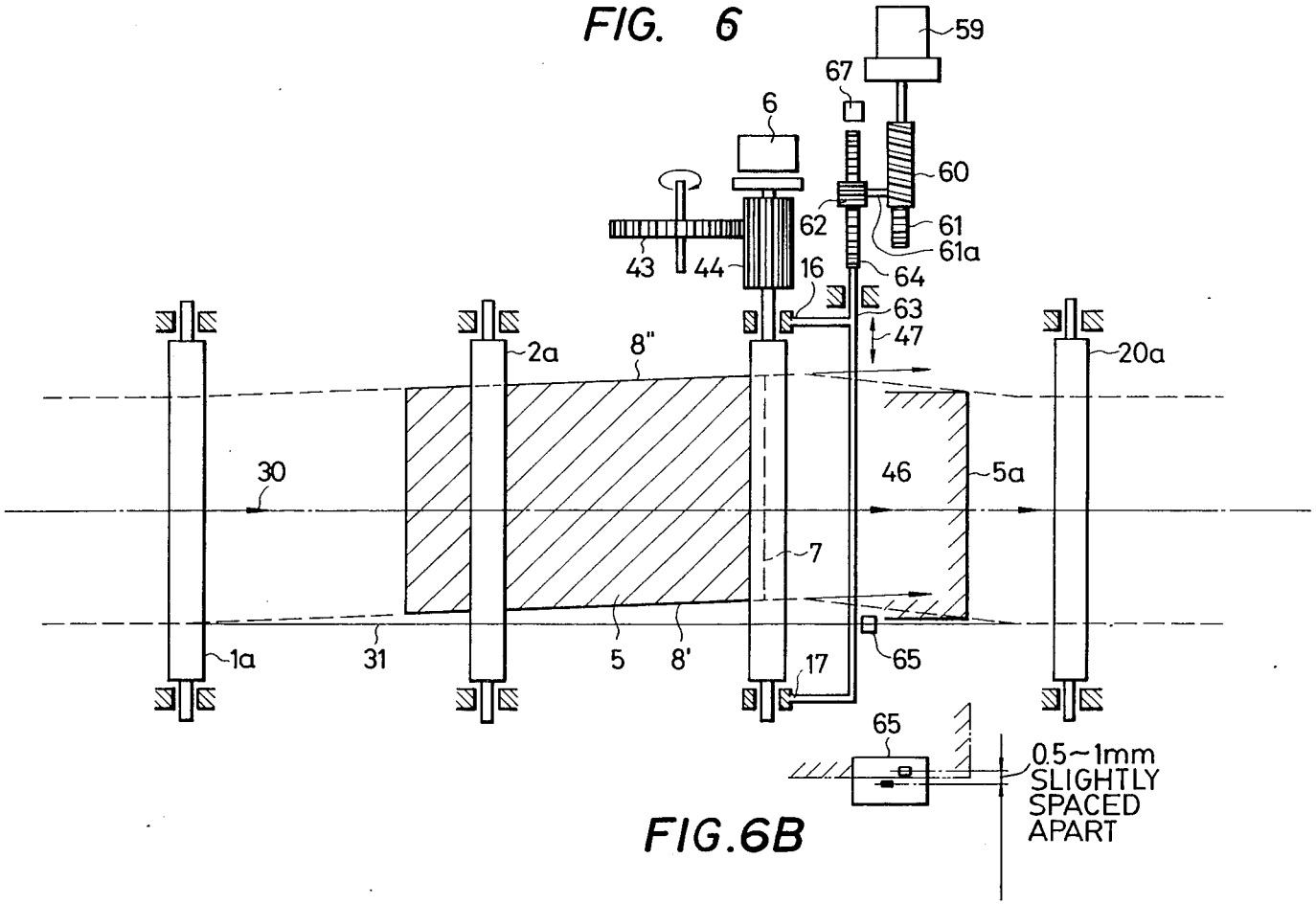
FIG. 6 is a plan view of a sheet conveying device to which still another embodiment of the present invention is applied.

FIB. 6B is a plan view of the sensor 65 shown in FIG. 6.

Figure 7:
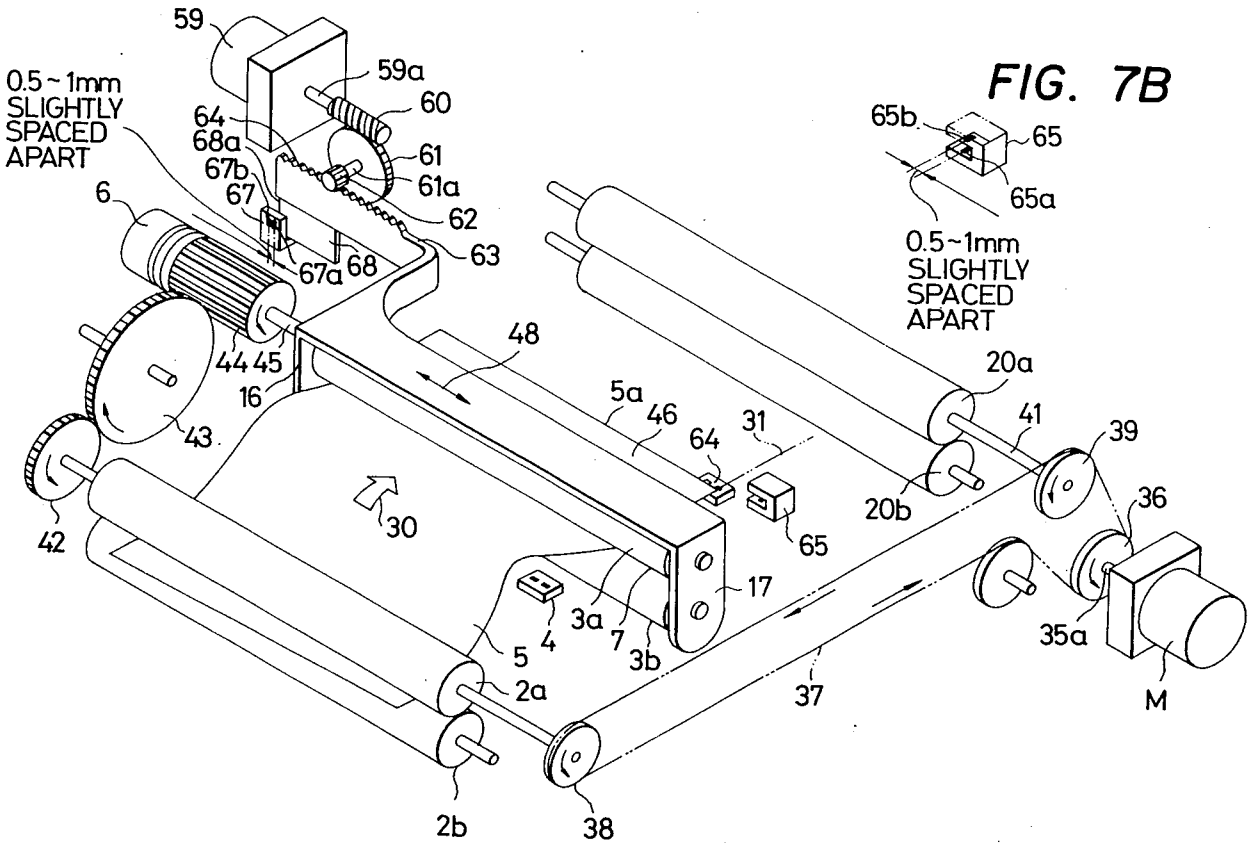

FIG. 7 is a perspective view of the sheet conveying device shown in FIG. 6.

FIG. 7B is a perspective view of the sensor 65 shown in FIG. 7.

Figure 8:
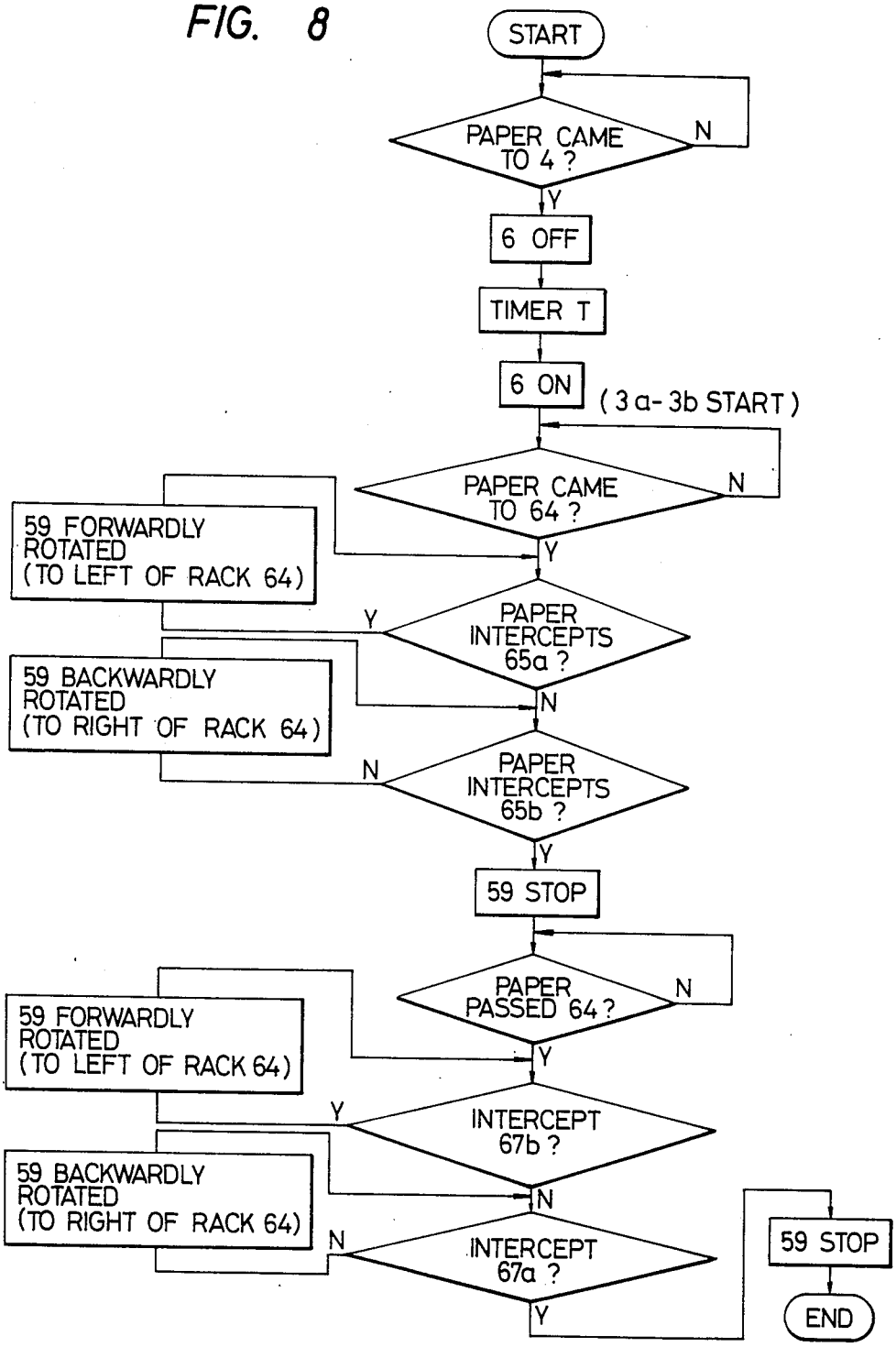

FIG. 8 is a flow-chart.

DESCRIPTION OF THE PREFERRED EMBODIMENTS

The epitome of an embodiment of the present invention will first be described.

In the present embodiment, correcting rollers longer than the width of a paper sheet are stopped for a short time, whereby the forward edge of the paper sheet strikes against the contact line of the correcting rollers. In this state, the paper sheet is further transported by a pair of conveyor rollers disposed upstream in the direction of conveyance, whereby the paper sheet swells and forms a loop between the pair of conveyor rollers and the pair of correcting rollers and the forward edge thereof strikes against the contact line of the correcting rollers and becomes uniform in position. Thereby, even when the paper sheet is obliquely fed, it is corrected to a proper direction of conveyance.

Here, the swell of the paper sheet becomes larger until the pair of conveyor rollers disposed upstream liberate the paper sheet and accordingly the feed of the paper sheet does not occur or is stopped. The correcting rollers begin to rotate again when said swell has become suitably large. At the same time, the pair of correcting rollers move on the axis until the passing paper sheet assumes its proper position with respect to a predetermined conveyance path. The pair of conveyor rollers succeeding to the pair of correcting rollers are disposed at such a distance from the pair of correcting rollers that they seize the paper sheet only after complete adjustment thereof has been terminated. The stoppage of the pair of correcting rollers and the magnitude of the sliding of the pair of correcting rollers on the axis can be controlled, for example, by a light interceptor.

The present invention will hereinafter be described in greater detail with respect to embodiments thereof.

A first embodiment of the present invention will first be described by reference to FIGS. 1–5.

In these Figures, usually, a paper sheet 5 is first conveyed in the direction of arrow 30 by rotation of a pair of conveyor rollers 1*a* and 1*b* (in the directions of arrows), and then is conveyed in a predetermined direction of conveyance along a reference line 31 by rotation of a pair of conveyor rollers 2*a* and 2*b*, a pair of correcting rollers 3*a* and 3*b* and a pair of conveyor rollers 20*a* and 20*b* (in the directions of arrows). When, in this course of conveyance, the sheet 5 deviates from the reference line 31 and so-called oblique feeding (this state is indicated by dotted lines a and b in FIG. 2) occurs, in the present embodiment, such oblique feeding of the sheet 5 can be corrected by the cooperation between the pair of conveyor rollers 2*a* and 2*b* and the pair of correcting rollers 3*a* and 3*b* displaceable in a direction perpendicular to the predetermined direction of conveyance and the sheet 5 can again be conveyed along the reference line 31.

A construction for correcting the oblique feeding of the sheet in the present embodiment will hereinafter be described specifically.

Figure 2:
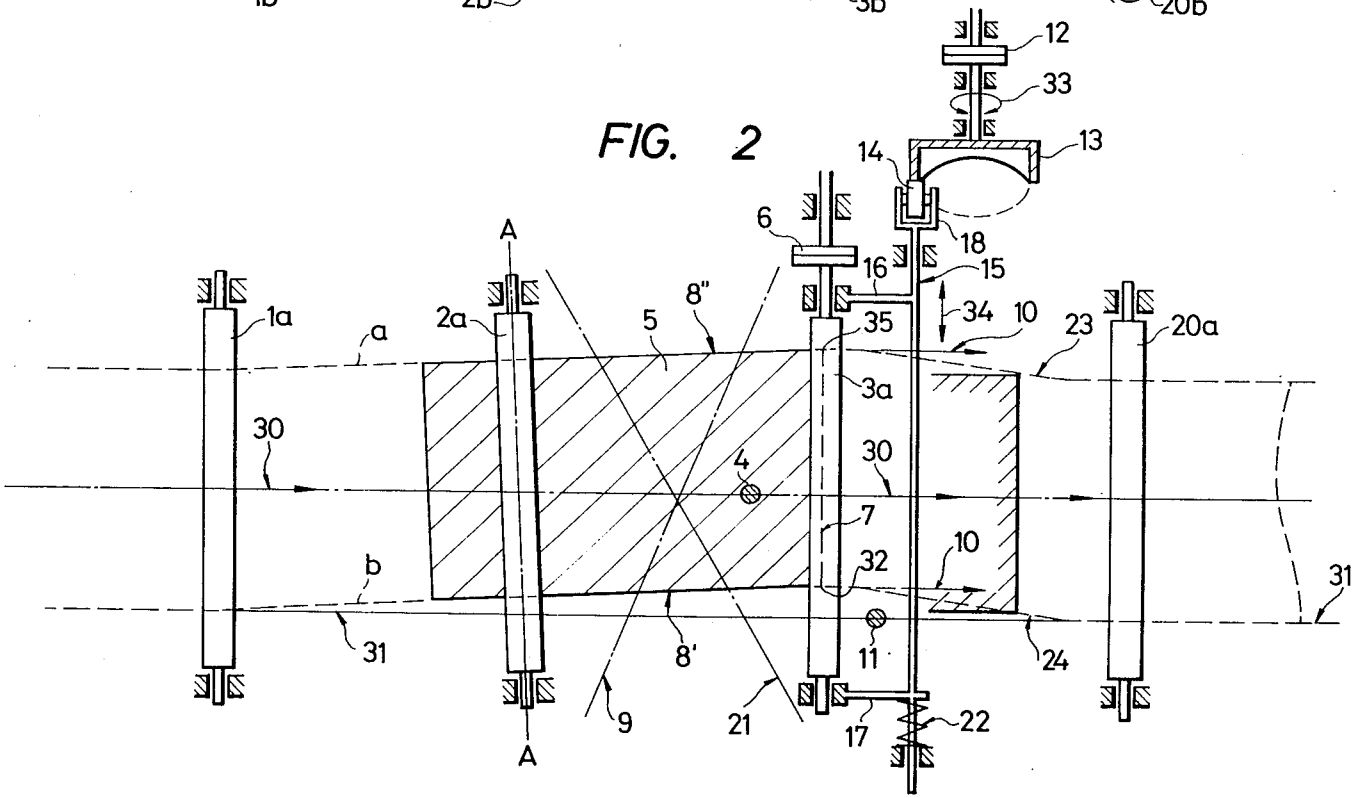
FIG. 2 is a plan view of the sheet conveying device.

The cause of the oblique movement of the sheet in the course of conveyance thereof may be, for example, that the pair of conveyor rollers are urged against each other with a non-uniform force over the full length thereof, or that these rollers are slightly conically shaped for some reason or other in the manufacture thereof, or that the surface of one of the pair of rollers is stained or that the axis A—A of the pair of rollers is not perpendicular to the direction of movement of the paper sheet (the direction of arrow 30) (in FIG. 2, there is shown an example in which oblique movement of the sheet 5 has occurred due to this cause).

The driving of the conveyor rollers and the correcting rollers will first be described by reference to FIG. 4.

The drive force of a motor M is transmitted to a gear 36 secured to a motor shaft 35 and further transmitted to gears 38 and 39 through a chain 37. Thus, roller shafts 40 and 41 to which the gears 38 and 39 are secured are rotated by the drive of the motor M, so that the rollers 2*a* and 20*a* begin to rotate. A gear 42 is secured to the other end of the roller shaft 40, and rotation of this gear 42 is transmitted to an elongated gear 44 through a gear 43. The elongated gear 44 is mounted for idle rotation on the shaft 45 of the correcting roller 3*a* and transmits the drive to the shaft 45 upon engagement of a clutch 6 to thereby rotate the roller 3*a*. Accordingly, the roller 3*a* repeats its rotation and stoppage by the engagement and disengagement of the clutch 6 even if the motor M continues to drive.

The rollers 2*b*, 3*b* and 20*b* rotate following the rotation of the drive rollers 2*a*, 3*a* and 20*a*, respectively. Although not shown, the pair of conveyor rollers 1*a* and 1*b* are likewise rotated by the drive of the motor M through the chain 37.

The pair of correcting rollers 3*a* and 3*b* are supported by a frame member 46 with their shafts supported by arms 16 and 17 perpendicularly to the predetermined direction of conveyance of the sheet. The frame member 46 is connected to a bar 15 extending in a direction perpendicular to the predetermined direction of conveyance of the sheet, and a roller 14 provided in a fork 18 is rotatably mounted on the end of the bar 15. The roller 14 is engaged with a rotatable inclined plate 13 rotatable in the direction of arrow 33 and rotates on the inclined plate 13. Thus, in response to the rotation of the rotatable inclined plate 13 in the direction of arrow 33, the bar 15 and the frame member 46 horizontally reciprocate in directions perpendicular to the predetermined direction of conveyance of the sheet (the directions of arrows 47 and 48). The distance of movement of the bar 15 is determined by the angle of rotation of the rotatable inclined plate 13. Also, when the frame member 46 horizontally moves in the direction of arrow 48, the elongated gear 44 slidably moves on the gear 43 while being in mesh engagement therewith and therefore, the gears 43 and 44 are never disengaged from each other and they can continue to rotate even when the pair of rollers 3*a* and 3*b* are moving in the axial direction.

Figure 3:
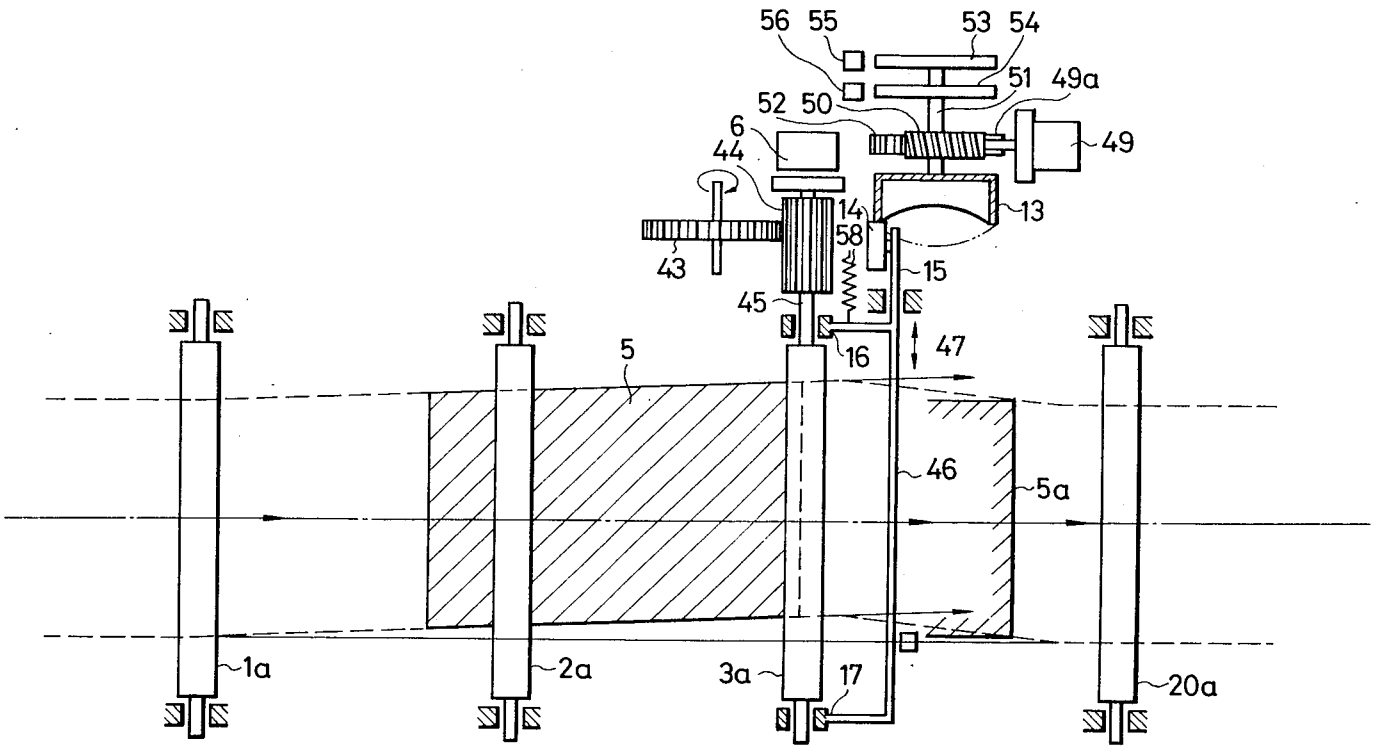
FIG. 3 is a plan view of a sheet conveying device to which another embodiment of the present invention is applied.
Figure 4:
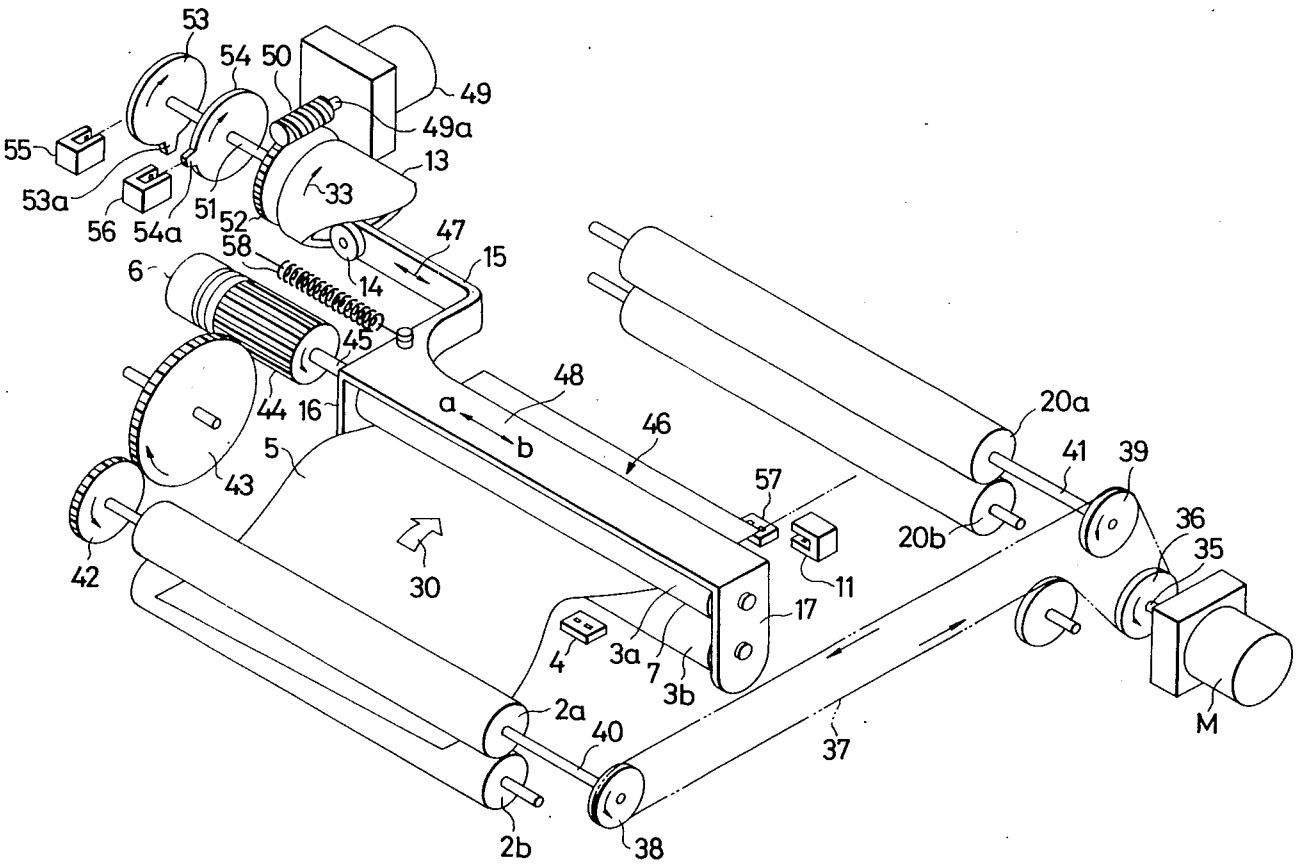
FIG. 4 is a perspective view of the sheet conveying device shown in FIG. 3.
Figure 5:
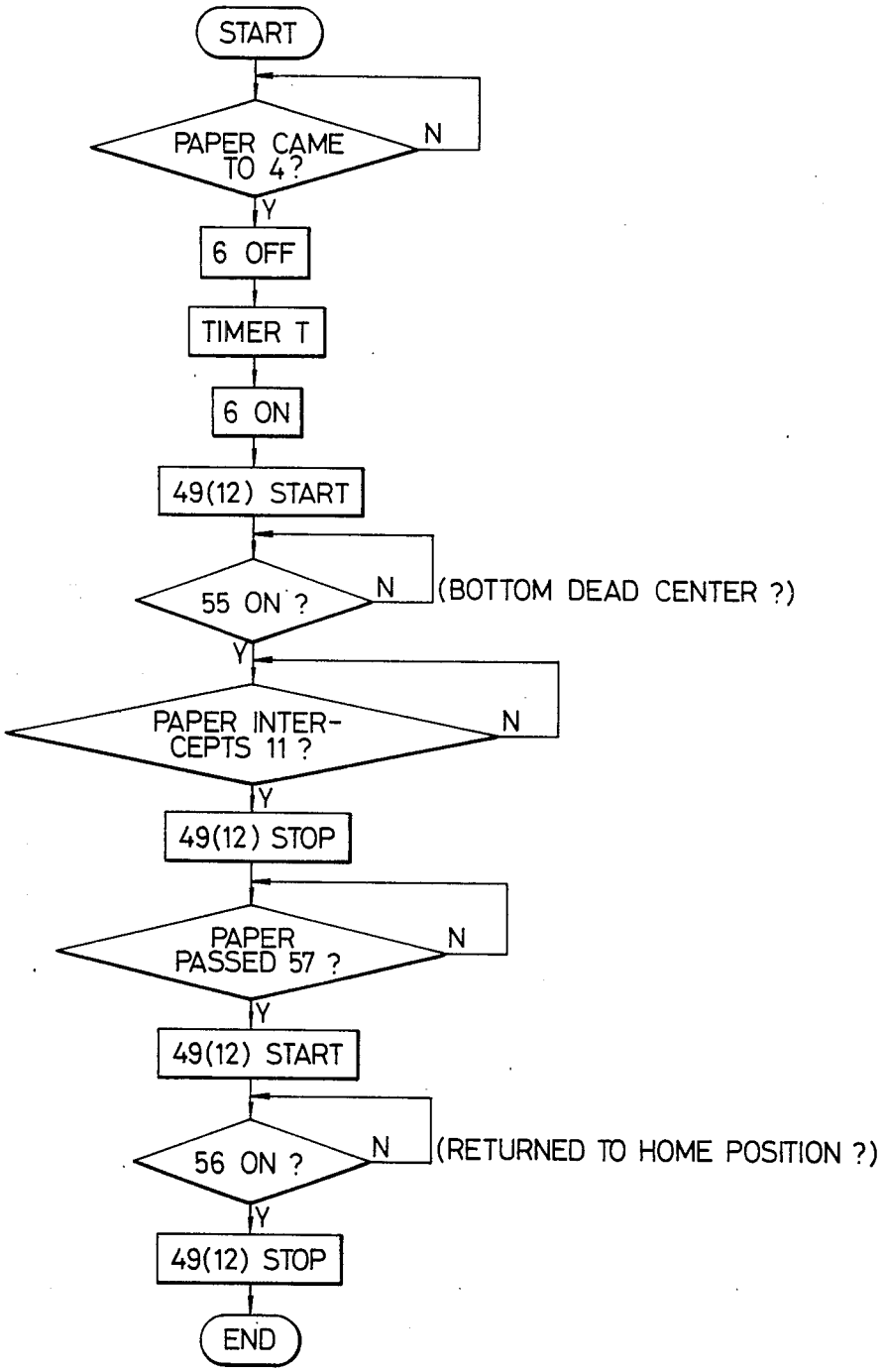
FIG. 5 is a flow chart.

As shown in FIGS. 3 and 4, rotation of the rotatable inclined plate 13 is accomplished by the drive of a motor 49 being transmitted through a gear 50 to a gear 52 secured to the shaft 51 of the rotatable inclined plate 13. Discs 53 and 54 are also secured to the shaft 51, and passage of the projected portions 53*a* and 54*a* thereof is detected by sensors 55 and 56, whereby the motor 49 is energized and deenergized to control the angle of rotation of the rotatable inclined plate 13. The sensor 55 serves to detect the arrival of the inclined plate 13 at the bottom dead center and the sensor 56 serves to detect the arrival of the inclined plate 13 at its home position. Further, a spring 58 has one end thereof secured to the frame member 46 and ensures the engagement between the rotatable inclined plate 13 and the roller 14. In the embodiment shown in FIG. 2, control of the rotation of the rotatable inclined plate 13 is accomplished by ON-OFF of a coupling 12.

The fork 18 is not shown in FIGS. 3 and 4. In FIG. 2, spring 22 is shown as being secured to the side plate 17 of the frame member 46 and, in FIG. 4, spring 58 is shown as being secured to the side plate 16 of the frame member 46, but these springs 22 and 58 are identical in function and both of them are practicable and therefore, both examples are shown. Similarly, in the embodiment shown in FIG. 2, control of the rotation of the rotatable inclined plate 13 is shown as being accomplished by ON-OFF of the coupling 12 and, in FIGS. 3 and 4, control of the rotation of the rotatable inclined plate 13 is shown as being accomplished by ON-OFF of the motor 49, but both of them are practicable and therefore, both examples are shown.

Description will now be made of the correcting function of causing a sheet obliquely fed while being deviated from the reference line (including a case where the sheet is deviated parallel from the reference line) in the present embodiment to return to the proper conveyance path along the reference line.

Description will first be made on the assumption that the sheet 5 is deviated toward dotted lines a and b.

Figure 1:
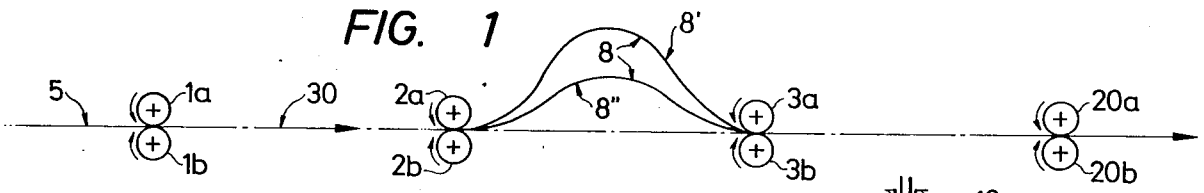
FIG. 1 is a side view of a sheet conveying device to which an embodiment of the present invention is applied.

First, the pairs of conveyor rollers 1*a*, 1*b*; 2*a*, 2*b*; 20*a*, 20*b* and the pair of correcting rollers 3*a*, 3*b* start to rotate by the drive of the motor M. Thereby, the sheet 5 is conveyed and the leading end edge thereof arrives at the sensor 4. Thereupon, in response to the signal from this sensor 4, the clutch 6 becomes disengaged and the pair of correcting rollers 3*a*, 3*b* stop rotating. Since the sheet 5 is subjected to a conveying force by the rollers 2*a*, 2*b*, the leading end edge thereof strikes against the peripheral surfaces of the pair of rollers 3*a*, 3*b* and, as shown in FIG. 1, the sheet 5 swells and forms a loop between the pair of conveyor rollers 2*a*, 2*b* and the pair of correcting rollers 3*a*, 3*b*. Thus, the leading end edge 5*a* of the sheet 5 becomes uniform in position at the contact line 7 of the rollers 3*a* and 3*b*. Since the rollers 3*a* and 3*b* are supported perpendicularly to the regular direction of conveyance, the leading end edge 5*a* of the sheet 5 is corrected to a proper direction of conveyance. In FIG. 2, the right end of the sheet 5 is indicated as 8' and the left end thereof is indicated as 8''.

Subsequently, when a predetermined time (a time during which at least the full width of the leading end edge of the sheet bears against the contact line 7) elapses after the rollers 3*a* and 3*b* are stopped by the operation of a timer circuit (not shown), the clutch 6 becomes engaged in response to a signal and the rollers 3*a* and 3*b* begin to rotate. Thereby, the sheet 5 corrected to the proper direction of conveyance enters into between and is nipped between the rollers 3*a* and 3*b*, and simultaneously with or very slightly after the engagement of the clutch 6, the rotatable inclined plate 13 begins to rotate in response to the signal from the timer circuit (not shown). Control of the rotation of the inclined plate 13 is accomplished by the coupling 12 becoming ON-OFF in response to a signal (the embodiment shown in FIG. 2) or by the motor 49 becoming ON-OFF in response to a signal (the embodiment shown in FIGS. 3 and 4).

This inclined plate 13 continues to rotate until the projection 53*a* of the disc 53 obstructs the sensor 55, that is, the inclined plate 13 arrives at the bottom dead center and further the side edge of the sheet 5 nipped between the rollers 3*a* and 3*b* is detected by a sensor 11 disposed correspondingly to the reference line 30. When the side edge 8' of the sheet 5 is detected by the sensor 11, the rotatable inclined plate 13 stops rotating in response to the detection signal. That is, in response to the signal from the sensor 11, the coupling 12 becomes OFF (the embodiment shown in FIG. 2) or the motor 49 stops (the embodiment shown in FIGS. 3 and 4). That is, the rollers 3*a* and 3*b* are once displaced in the direction a of arrow 48 in response to the rotation of the rotatable inclined plate 13, and thereafter are displaced in the direction b of arrow 48 to a position whereat the side edge 8' of the sheet 5 nipped between the rollers 3*a* and 3*b* comes to the reference line 30, and then are stopped. Here, the forward edges 32 and 35 of the sheet 5 move toward lines 23 and 24 indicated by dotted lines when the sheet 5 thus parallel-moves. In the meantime, the rollers 3*a* and 3*b* continue to convey the sheet 5 toward the pair of rollers 20*a* and 20*b*. Thus, during the lateral movement of the sheet 5, the swell 8 of the sheet 5 jumps from a position 9 to a position 21 as indicated by broken line in FIG. 2. Also, the sheet 5 arrives at its predetermined position before the forward edge thereof arrives at the pair of conveyor rollers 20. In this manner, in the present embodiment, the sheet, even if deviated from the reference line, can be fed in a predetermined direction of conveyance with the oblique movement thereof being corrected. When the trailing end edge of the sheet 5 passes by a sensor 57 provided downstream of the pair of correcting rollers 3*a* and 3*b*, the coupling 12 becomes ON (the embodiment shown in FIG. 2) or the motor 49 begins to rotate (the embodiment shown in FIGS. 3 and 4), in response to the signal from the sensor 57. Then, the inclined plate 13 begins to rotate and stops rotation in response to the signal from the sensor 56 at a position whereat the projection 54*a* of the disc 54 has obstructed the sensor 56, that is, a position whereat the inclined plate 13 has arrived at its home position. Thus, the pair of correcting rollers 3*a* and 3*b* again return to their home position.

In the present embodiment, not only a sheet obliquely fed to the left can be returned in the predetermined direction of conveyance, but also a sheet obliquely fed to the right can be returned in the predetermined direction of conveyance. This is because, in the present embodiment, when the rotatable inclined plate 13 begins to rotate from its home position, the bottom dead center thereof once passes the roller 14, whereby the pair of correcting rollers 3*a* and 3*b* are once displaced to the left and then to the right.

In order that sheets may be conveyed along various paths, several sensors can be provided correspondingly to the predetermined conveyance positions of these sheets.

Another embodiment of the present invention will now be described by reference to FIGS. 6 to 8.

In this embodiment, a rack and a pinion are used instead of the rotatable inclined plate and the pair of correcting rollers are parallel-moved. In the present embodiment, members similar to those in the previous embodiment are given similar reference numerals.

In the present embodiment, the drive of a reversible motor 59 is transmitted to a gear 60 secured to the motor shaft 59*a* of the motor 59 and a gear 61 in mesh engagement with the gear 60, and rotates a pinion 62 secured to the end of a gear shaft 61*a* which is integral with the gear 61. A rack 64 is provided on the end of a bar 63 extending from a frame member 46 perpendicularly to a predetermined direction of sheet conveyance. The rack 64 and the pinion 62 are in mesh engagement with each other, so that the rack 64 is movable leftwardly by forward (clockwise) rotation of the pinion 62 and movable rightwardly by reverse (counter-clockwise) rotation of the pinion 62. That is, by forward and reverse rotation of the motor 59, the pair of correcting rollers 3*a* and 3*b* are horizontally reciprocated in a direction perpendicular to the predetermined direction of sheet conveyance.

Description will now be made of the function of correcting the oblique feeding of the sheet in the present embodiment.

First, when the leading end edge of the sheet 5 arrives at the sensor 4 by rotation of the pair of conveyor rollers 2*a* and 2*b*, the pair of correcting rollers 3*a* and 3*b* stop rotating in response to a signal resulting therefrom. Thus, the leading end edge 5*a* of the sheet 5 strikes against the contact line 7 of the pair of correcting rollers 3*a* and 3*b* and becomes uniform in position. Thus, the leading end edge 5*a* of the sheet 5 has come to again face the predetermined direction of conveyance. When the rollers 3*a* and 3*b* again begin to rotate by a timer circuit or the like (not shown) in a predetermined time after the rollers 3*a* and 3*b* have stopped, the sheet 5 is conveyed toward the pair of rollers 20*a* and 20*b* while facing the predetermined direction of conveyance but being deviated from the reference line 31. When the leading end edge 5*a* of the sheet 5 arrives at a sensor 64, the pair of rollers 3*a* and 3*b* are displaced in response to the signal from a conveyance position correcting sensor 65 having two detecting portions 65*a* and 65*b* on the opposite sides of the reference line 31. Control of the displacement of the pair of rollers 3*a* and 3*b* will hereinafter be described. The sensor 65 is in FIG. 6B. The spacing between the two detecting portions 65*a* and 65*b* is about 0.5–1.0 mm, and the detecting portion 65*a* lies outside with respect to the reference line 31 and the detecting portion 65*b* lies inside with respect to the reference line 31. When the detecting portions 65*a* and 65*b* are intercepted by the sheet 5, the motor 59 rotates in forward direction by the signal from the detecting portion 65*a* to move the rack 64 leftwardly and also move the pair of rollers 3*a* and 3*b* leftwardly. Thereafter, when the sheet 5 intercepts only the detecting portion 65*b*, that is, when the side edge of the sheet 5 comes to lie between the detecting positions 65*a* and 65*b* and becomes coincident with the reference line 31, the displacement of the pair of rollers 3*a* and 3*b* is stopped. That is, when the sheet 5 has returned to the predetermined conveyance path. On the other hand, when the detecting portions 65*a* and 65*b* are not intercepted by the sheet, the motor 59 rotates in reverse direction by the signal from the detecting portion 65*b* until the detecting portion 65*b* is intercepted by the sheet 5, whereby the rack 64 is moved rightwardly and the pair of rollers 3*a* and 3*b* are also moved rightwardly. Thereafter, when the sheet 5 intercepts only the detecting portion 65*b*, that is, when the side edge of the sheet 5 comes to lie between the detecting portions 65*a* and 65*b* and becomes coincident with the reference line 31, the displacement of the pair of rollers 3*a* and 3*b* is stopped. Thus, the sheet 5 has returned to the predetermined conveyance path.

When the trailing end edge of the sheet 5 passes by the sensor 64, the side edge 68*a* of a detecting plate 68 provided at the lower end of the rack 64 is detected by a sensor 67 having detecting portions 67*a* and 67*b* and the pair of rollers 3*a* and 3*b* are returned to their home position.

In the present invention, the fact that the sheet is conveyed in the predetermined direction of conveyance includes the feature according to which a sheet deviated parallel with respect to the predetermined direction of conveyance is corrected to the predetermined conveyance path.

According to the present invention, as described above, oblique feeding of a sheet can be quickly corrected in a short distance without any load being imparted to the sheet.

What I claim is:

1. A sheet conveying device for conveying sheets in a predetermined direction of conveyance, comprising:

a pair of first sheet conveying rollers for conveying sheets;

a pair of second sheet conveying rollers provided downstream of said first sheet conyeying rollers with respect to the direction of conveyance;

means for forming a loop in a sheet between said first and second sheet conveying rollers by conveying force of said first sheet conveying rollers;

means for displacing said second sheet conveying rollers nipping said sheet therebetween in a direction perpendicular to the predetermined direction of conveyance while maintaining the loop;

detector means for detecting the side edge of the sheet nipped between the second sheet conveying rollers displaced by said displacing means so as to stop said displacing means; and means for returning said second sheet conveying rollers to a home position after the rear edge of the sheet has passed through said second sheet conveying rollers.

2. A sheet conveying device for conveying sheets in a predetermined direction of conveyance comprising:

a pair of conveyor rollers for conveying sheets;

a pair of correcting rollers disposed downstream of said pair of conveyor rollers with respect to the direction of conveyance and perpendicularly to the predetermined direction of conveyance;

means for rotating said correcting rollers after the leading edge of a sheet conveyed by rotation of said pair of conveyor rollers strikes against said correcting rollers and forms a loop nipping the sheet between said correcting rollers;

moving means for moving, while maintaining the loop, said pair of correcting rollers axially thereof simultaneously with or after the rotation of said correcting rollers;

detector means for detecting the side edge of the sheet nipped between the pair of rollers displaced by said moving means so as to stop said moving means; and means for returning said correcting rollers to a home position after the rear edge of the sheet has passed through said correcting rollers.

3. A sheet conveying device for conveying sheets in a predetermined direction of conveyance, comprising:

a pair of conveyor rollers for conveying sheets;

a pair of correcting rollers disposed downstream of said pair of conveyor rollers with respect to the direction of conveyance and perpendicularly to the predetermined direction of conveyance;

means for rotating said correcting rollers after the leading end edge of a sheet conveyed by rotation of said pair of conveyor rollers strikes against said correcting rollers and forms a loop;

moving means for moving, while maintaining the loop, said pair of correcting rollers axially thereof simultaneously with or after the rotation of said correcting rollers; and detector means for detecting the side edge of the sheet nipped between the pair of rollers displaced by said moving means so as to stop said moving means;

said moving means displacing said correcting rollers in the same direction without relation to the direction of positional displacement of the lateral direction of the sheet;

said moving means stopping when the sheet approaches said detecting means from the same direction and the side of the sheet is detected thereby.

* * * * *